US009427655B1

(12) United States Patent
Moody

(10) Patent No.: US 9,427,655 B1
(45) **Date of Patent: *Aug. 30, 2016**

(54) POLYGON-SHAPED GAME SYSTEM

(71) Applicant: Richard L. Moody, Lutz, FL (US)

(72) Inventor: Richard L. Moody, Lutz, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/806,057

(22) Filed: Jul. 22, 2015

Related U.S. Application Data

(63) Continuation-in-part of application No. 14/473,481, filed on Aug. 29, 2014, now Pat. No. 9,155,957, which is a continuation-in-part of application No. 14/026,866, filed on Sep. 13, 2013, now Pat. No. 9,017,179.

(51) Int. Cl.

| | |
|---|---|
| ***A63C 19/00*** | (2006.01) |
| ***A63B 67/00*** | (2006.01) |
| ***A63B 71/02*** | (2006.01) |
| *E01C 13/00* | (2006.01) |

(52) U.S. Cl.
CPC ..... *A63C 19/00* (2013.01); *A63B 67/002* (2013.01); *A63B 71/022* (2013.01)

(58) Field of Classification Search
CPC ..... A63C 19/00; A63C 19/02; A63C 19/08; A63C 2019/085; E01C 13/00; E01C 13/08; E01C 3/003; E04F 15/00; E04F 15/02
USPC ..... 472/92–94, 136; 256/25; 473/415
See application file for complete search history.

(56) References Cited

U.S. PATENT DOCUMENTS

| | | | | |
|---|---|---|---|---|
| 4,819,582 | A * | 4/1989 | Lichvar | A01K 1/03 119/474 |
| 5,050,867 | A * | 9/1991 | Rand | A63C 19/12 472/92 |
| 5,622,021 | A * | 4/1997 | Bookout | E04H 3/14 248/351 |
| 5,738,588 | A * | 4/1998 | Esser | A63C 19/00 256/24 |
| 6,004,218 | A * | 12/1999 | Keating | A63C 19/06 256/24 |
| 6,394,918 | B1 * | 5/2002 | Erhard | A63C 19/06 472/92 |

* cited by examiner

*Primary Examiner* — Kien Nguyen

(57) ABSTRACT

A polygon-shaped field has two opposed ends, two opposed sides, and a plurality of intermediate components. Each side end and side and intermediate component is formed of panels having vertical and horizontal rails. Vertical extender rails extend upwardly from the panels. A plurality of variously shaped connectors couple together the rails of the panels and the extenders. Stabilizers extend outwardly from at least some of the panels. Flexible fabric netting is located between the rails of the panels and the extenders.

8 Claims, 4 Drawing Sheets

56
54

100
56
112
110
108
7
104

POLYGON-SHAPED GAME SYSTEM

RELATED APPLICATION

The present application is a continuation-in-part of pending application Ser. No. 14/026,866 filed Sep. 13, 2013, which in turn is, in turn, a continuation-in-part of application Ser. No. 14/473,876 filed Sep. 13, 2013 and issued Apr. 28, 2015 as U.S. Pat. No. 9,017,179, the subject matter of which applications is incorporated herein by reference.

BACKGROUND OF THE INVENTION

1. Field of the Invention

The present invention relates to a polygon-shaped game system and more particularly pertains to fields which are readily assembled for playing games and disassembled for transportation and storage. The assembling and disassembling of fields and the playing of games are done in a safe, convenient, and economical manner.

2. Description of the Prior Art

The use of game fields of known designs and configurations is known in the prior art. More specifically, game fields of known designs and configurations previously devised and utilized for the purpose of providing a playing area for games are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a polygon-shaped game system that allows fields to be readily assembled for playing games and disassembled for transportation and storage, the fields when assembled being arranged for play, the assembling and disassembling of fields and the playing of games being done in a safe, convenient, and economical manner.

In this respect, the polygon-shaped game system according to the present invention substantially departs from the conventional concepts and designs of the prior art, and in doing so provides an apparatus primarily developed for the purpose of providing fields which are readily assembled for playing games and disassembled for transportation and storage. The fields when assembled are arranged for play. The assembling and disassembling of fields and the playing of games are done in a safe, convenient, and economical manner.

Therefore, it can be appreciated that there exists a continuing need for a new and improved polygon-shaped game system with fields which can be readily assembled for playing games and disassembled for transportation and storage, the assembling and disassembling of fields and the playing of games being done in a safe, convenient and economical manner. In this regard, the present invention substantially fulfills this need.

SUMMARY OF THE INVENTION

In view of the disadvantages inherent in the known types of game fields of known designs and configurations now present in the prior art, the present invention provides an improved polygon-shaped game system. As such, the general purpose of the present invention, which will be described subsequently in greater detail, is to provide a new and improved polygon-shaped game system which has all the advantages of the prior art and none of the disadvantages.

To attain this, the present invention essentially comprises a polygon-shaped game field with two opposed parallel ends and two opposed parallel sides and a plurality of intermediate sides. Each side and each end are formed of rectangular panels having vertical and horizontal rails. Vertical extender rails extend upwardly from the rectangular panels. A plurality of variously shaped connectors couple together the rails of the rectangular panels and the extender rails. Stabilizer support panels extend outwardly from at least some of the rectangular panels. Flexible fabric netting is located between the rails of the rectangular panels and the extender rails.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved polygon-shaped game system which has all of the advantages of the prior art game fields of known designs and configurations and none of the disadvantages.

It is another object of the present invention to provide a new and improved polygon-shaped game system which may be easily and efficiently manufactured and marketed.

It is a further object of the present invention to provide a new and improved polygon-shaped game system which is of safe, durable and reliable constructions.

An even further object of the present invention is to provide a new and improved polygon-shaped game system which is susceptible of a low cost of manufacture with regard to both materials and labor, and which accordingly is then susceptible of low prices of sale to the consuming public, thereby making such polygon-shaped game system economically available to the buying public.

Lastly, another object of the present invention is to provide a polygon-shaped game system for fields which are readily assembled for playing games and disassembled for transportation and storage. The assembling and disassembling of fields and the playing of games are done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
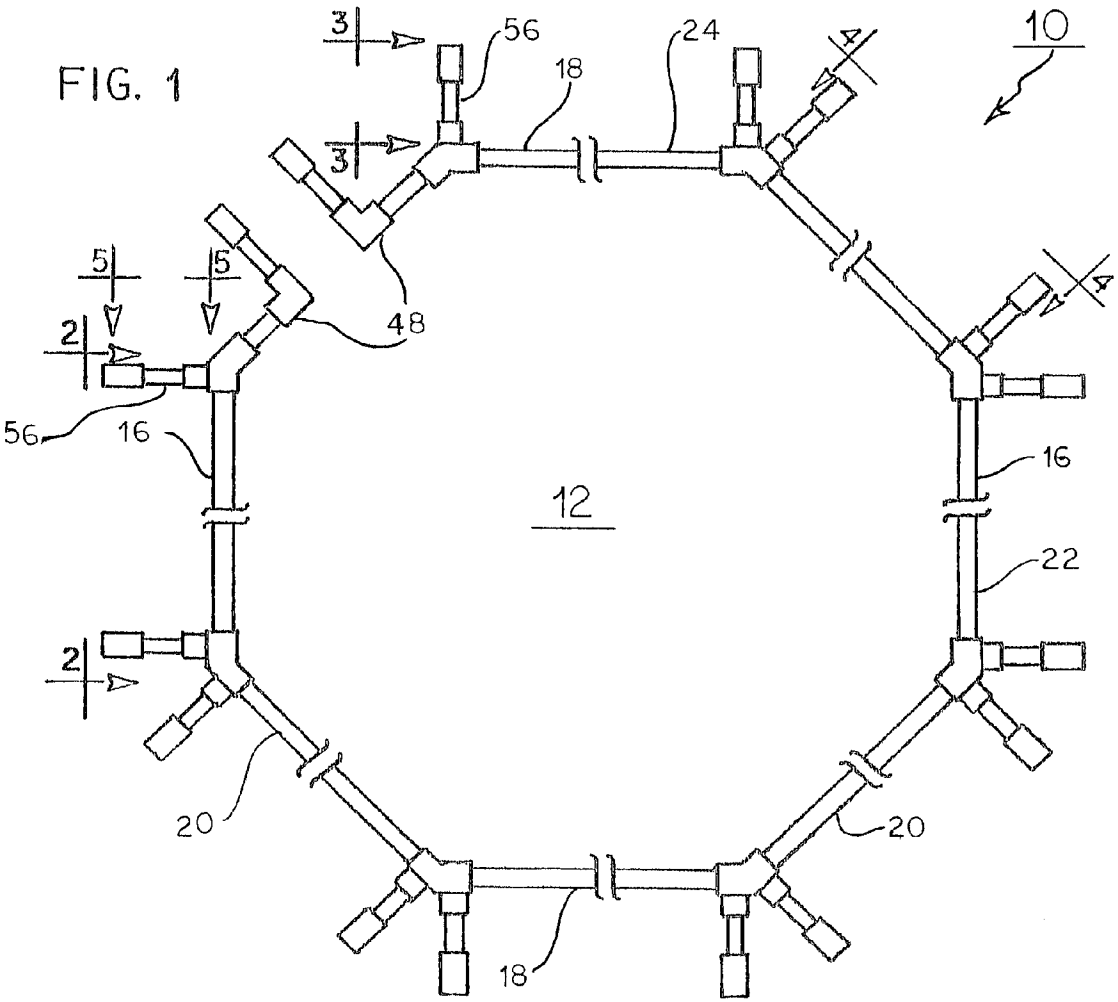
FIG. 1 is a plan view of a dodge ball game field constructed in accordance with the principles of the present invention.
Figure 3:
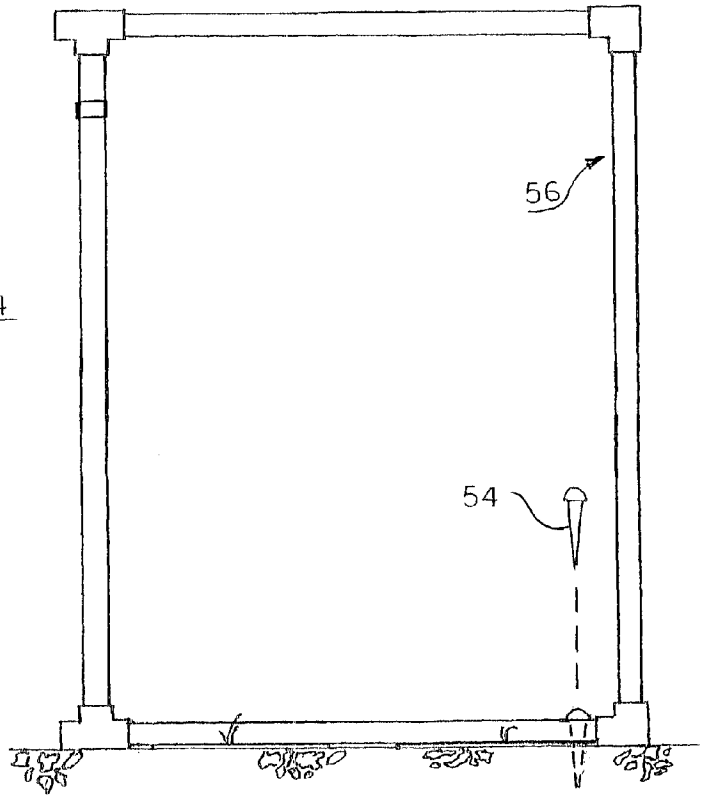
FIG. 3 is a front elevational view of a brace taken along line 3-3 of FIG. 1.
Figure 2:
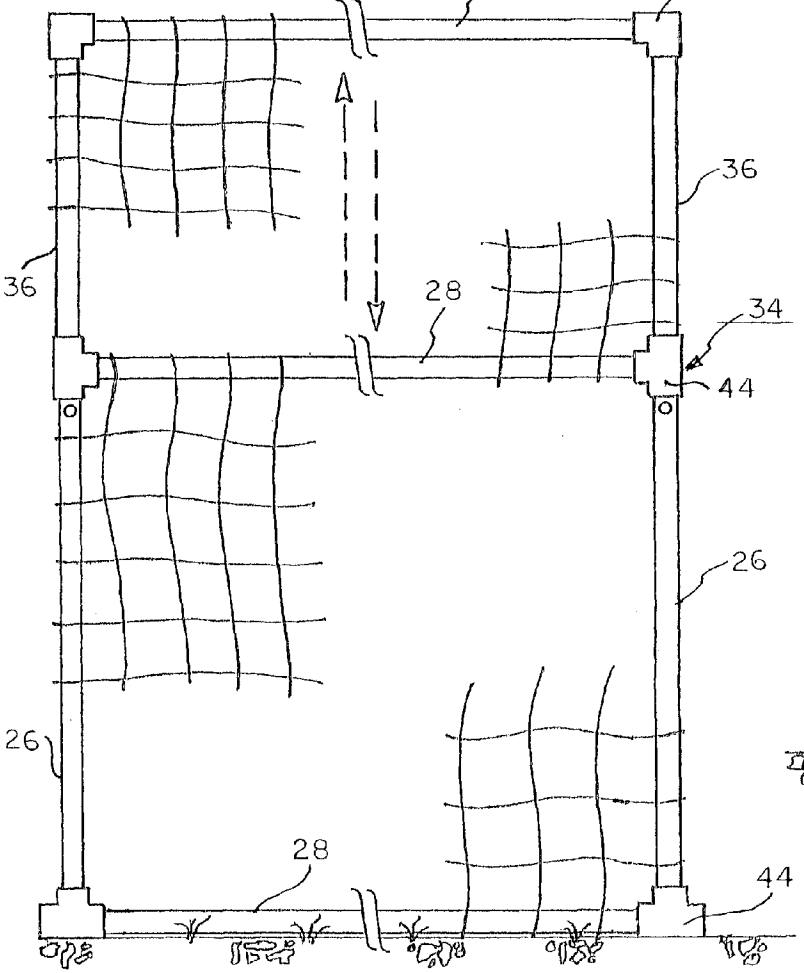
FIG. 2 is a front elevational view of a panel taken along line 2-2 of FIG. 1.
Figure 5:
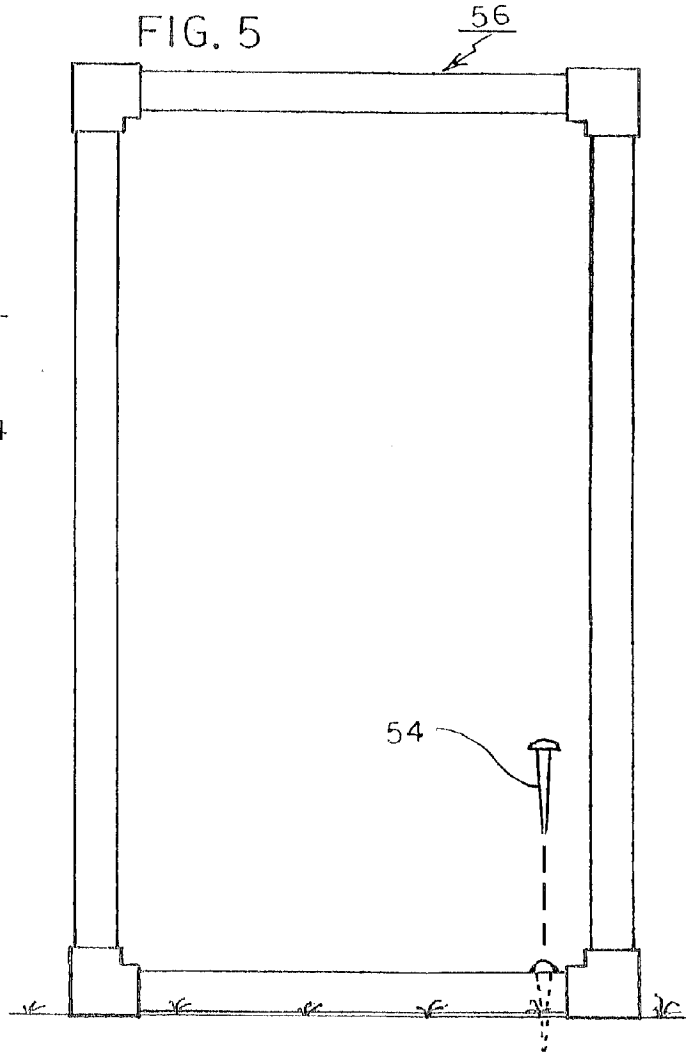
FIG. 5 is a front elevational view of a brace taken along line 5-5 of FIG. 1.
Figure 4:
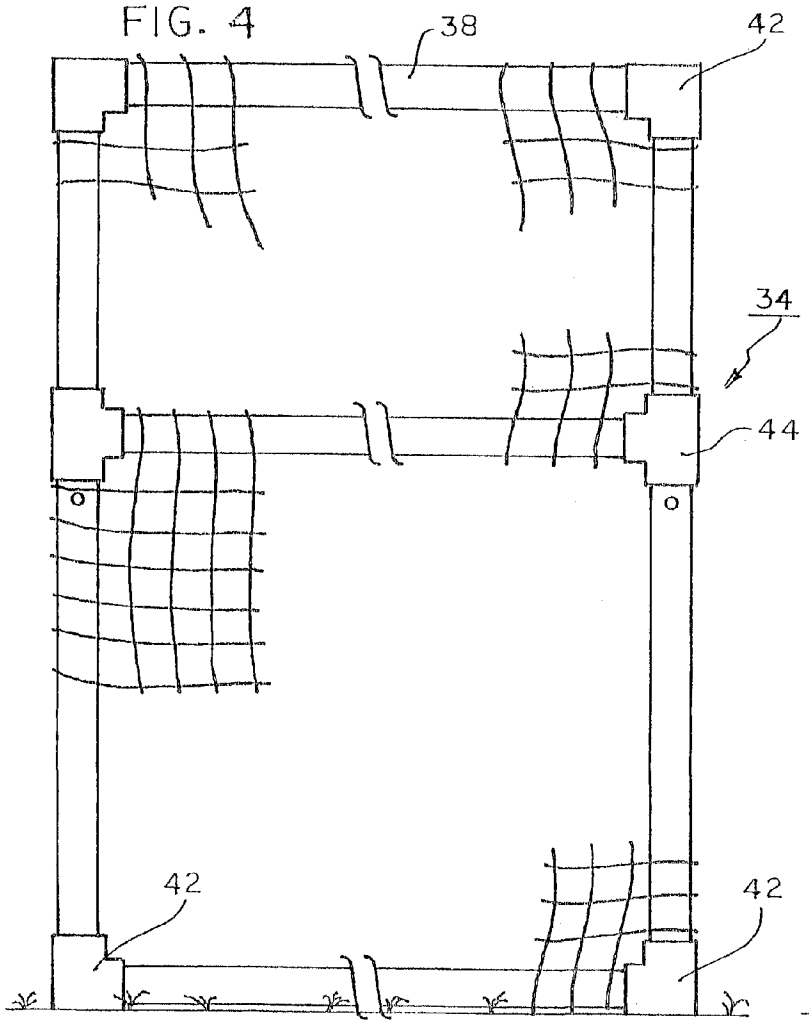
FIG. 4 is a front elevational view of a panel taken along line 4-4 of FIG. 1.

With reference now to the drawings, and in particular to FIG. 1 thereof, the preferred embodiment of the new and improved polygon-shaped game system embodying the principles and concepts of the present invention and generally designated by the reference numeral 10 will be described.

The present invention, the polygon-shaped game system 10 is comprised of a plurality of components. Such components in their broadest context include a rectangular dodge ball field, rectangular panels, vertical extender rails, a plurality of connectors, and flexible fabric. Such components are individually configured and correlated with respect to each other so as to attain the desired objective.

The polygon-shaped game system 10 of the present invention is formed of a dodge ball field 12. The field is readily assembled for playing games and disassembled for transportation and storage. The assembling and disassembling of fields and the playing of games is done in a safe, convenient, and economical manner.

The dodge ball field 12 is polygon-shaped. It has two similarly configured ends 16 spaced by a length, two similarly configured sides 18 spaced by a width, and a plurality of intermediate panels 20.

Each side is formed of side panels 22. Each end is formed of end panels 24. Each side panel, end panel, and intermediate panel is rectangular. Each has vertical rails 26 spaced by width. Each side and end panel has horizontal rails 28 with a height. The vertical rails are adjustable in length to vary the height of the side and end panels between a collapsed height and an extended length.

Each end panel has extender panels 34 formed of vertical extender rails 36 spaced by a length and laterally spaced by a width. Each extender panel has an upper horizontal extender rail 38 coupling adjacent vertical extender rails.

A plurality of variously shaped connectors are provided for coupling together rails of the side panels and the end panels and the extender panels. The various shaped connectors include L-shaped connectors 42, T-shaped connectors 44, and corner connectors 48. The corner connectors have opposed bores forming an angle of 45 degrees.

Securement components 54 are provided. The securement components are attached to the side panels and the end panels and extend downwardly therefrom to securely couple the field to a recipient surface.

Next provided are stabilizer support panels 56. The stabilizer support panels extend outwardly from at least some of the side panels and at least some of the end panels.

Flexible fabric netting 58 is provided. The flexible fabric netting is located between the rails of the side panels and the end panels and the extender panels.

The panels and extenders have a maximum height and form a playing periphery during use. In the preferred embodiment for games with teams of more than two team members, the playing periphery is from 35 to 45 times the maximum height.

Lastly, at least one door 64 is formed in a side panel adjacent to an end panel. The at least one door is formed of flexible fabric netting coupled solely to and depending from one of the horizontal rails.

In an alternate embodiment of the invention, the securement components 54 are spikes for use with the ground as the recipient surface.

Figures 6, 7:
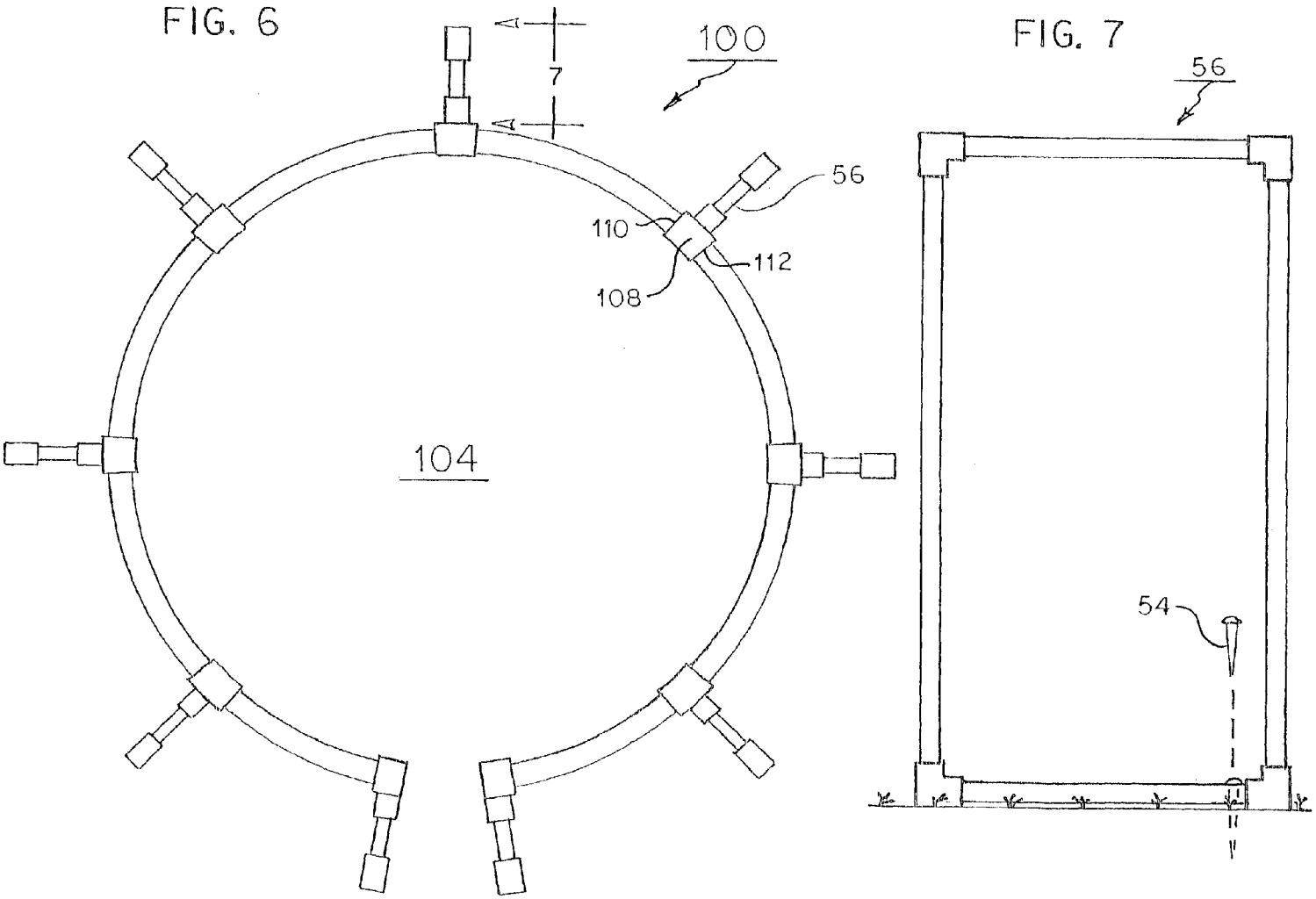
FIG. 6 is a plan view of a dodge ball game field constructed in accordance with an alternate embodiment of the invention.
FIG. 7 is a front elevational view of a brace taken along line 7-7 of FIG. 6.

An alternate embodiment of the invention is shown in FIGS. 6 and 7. In this embodiment of the system 100, the playing field 104 has a circular configuration. Panel connectors 108 are provided with bores 110, 112 at an angle of less than 15 degrees. In an embodiment for games with teams of two team members, the playing periphery is from 15 to 25 times the maximum height.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sports system comprising:

a polygon-shaped field having two opposed ends and two opposed sides and a plurality of intermediate components;

each side and each end and each intermediate component being formed of panels having vertical and horizontal rails;

vertical extender rails extending upwardly from the panels;

a plurality of variously shaped connectors for coupling together the rails of the panels and the extenders;

stabilizers extending outwardly from at least some of the panels; and flexible fabric netting located between the rails of the panels and the extenders.

2. The system as set forth in claim 1 wherein each stabilizer is rectangular in configuration with a vertical inner rail and a vertical outer rail and a horizontal upper rail and a horizontal lower rail.

3. The system as set forth in claim 1 wherein the panels and extenders have a maximum height and form a playing periphery during use, the playing periphery being from 35 to 45 times the maximum height for games with teams of more that two team members.

4. The system as set forth in claim 1 wherein the panels and extenders have a maximum height and form a playing periphery during use, the playing periphery being from 15 to 25 times the maximum height for games with teams of two team members.

5. The system as set forth in claim 1 wherein the playing field has a configuration with panel connectors with bores at an angle of less than 15 degrees.

6. The system (100) as set forth in claim 1 wherein the playing field (104) has a circular configuration with panel connectors (108) with bores (110)(112) at an angle of less than 15 degrees.

7. A polygon-shaped dodge ball system (10) formed of a dodge ball field (12), the field being readily assembled for playing games and disassembled for transportation and storage, the assembling and disassembling of fields and the playing of games being done in a safe, convenient, and economical manner, the system comprising, in combination:

the dodge ball field (12) being polygon-shaped and having two similarly configured ends (16) spaced by a length and having two similarly configured sides (18) spaced by a width having a plurality of intermediate panels (20);

each side being formed of side panels (22), each end being formed of end panels (24), each side panel and each end panel and each intermediate panel being rectangular and having vertical rails (26) spaced by width, each side and end panel having horizontal rails (28) with a height, the vertical rails being adjustable in length to vary the height of the side and end panels between a collapsed height and an extended length;

each end panel having extender panels (34) formed of vertical extender rails (36) spaced by a length and laterally spaced by a width, each extender panel having an upper horizontal extender rail (38) coupling adjacent vertical extender rails;

a plurality of variously shaped connectors for coupling together rails of the side panels and the end panels and the extender panels, the various shaped connectors including L-shaped connectors (42), T-shaped connectors (44), and corner connectors (48), the cornering connectors having opposed bores forming an angle of 45 degrees;

securement components (54) attached to the side panels and the end panels and extending downwardly therefrom to securely couple the field to a recipient surface;

stabilizer support panels (56) extending outwardly from at least some of the side panels and at least some of the end panels;

flexible fabric netting (58) located between the rails of the side panels and the end panels and the extender panels;

the panels and extenders having a maximum height and forming a playing periphery during use, the playing periphery being from 35 to 45 times the maximum height for games with teams of more that two team members; and at least one door (64) formed in a side panel adjacent to an end panel, the at least one door being formed of flexible fabric netting coupled solely to and depending from one of the horizontal rails.

8. The system as set forth in claim 7 wherein the securement components (54) are spikes and the recipient surface is the ground.

* * * * *